US005682611A

United States Patent [19]

Kline

[11] Patent Number: 5,682,611

[45] Date of Patent: Nov. 4, 1997

[54] THUMBGUARD

[76] Inventor: Samuel C. Kline, 1817 Green Hill Rd., Virginia Beach, Va. 23454

[21] Appl. No.: 713,421

[22] Filed: Sep. 13, 1996

[51] Int. Cl.[6] ..... A41D 19/00

[52] U.S. Cl. ..... 2/160; 2/161.1; 2/161.5; 2/161.6; 2/162; 2/169

[58] Field of Search ..... 2/158, 159, 160, 2/161.1, 161.2, 161.3, 161.4, 161.5, 161.6, 161.7, 161.8, 162, 163, 166, 170, 16, 17, 29, 20, 21

[56] References Cited

U.S. PATENT DOCUMENTS

| | | | |
|---|---|---|---|
| 3,344,436 | 10/1967 | Stubbs | 2/159 |
| 3,728,738 | 4/1973 | Andolino | 2/161.1 |
| 3,815,908 | 6/1974 | Hashimoto | 2/160 |
| 4,400,831 | 8/1983 | Rietz | 2/161.1 |
| 4,438,532 | 3/1984 | Campenella et al. | 2/161.1 |
| 4,608,720 | 9/1986 | Purin | 2/161.1 |
| 4,658,441 | 4/1987 | Smith | 2/161.1 |
| 4,730,354 | 3/1988 | Saito | 2/161.4 |
| 4,905,321 | 3/1990 | Walunga | 2/160 |
| 4,938,487 | 7/1990 | Ponsart | 2/163 |
| 4,958,384 | 9/1990 | McCrane | 2/162 |
| 5,004,227 | 4/1991 | Hoffman | 2/159 |
| 5,014,689 | 5/1991 | Meunchen et al. | 2/170 |
| 5,033,119 | 7/1991 | Wiggens | 2/161.4 |
| 5,414,868 | 5/1995 | Crawford | 2/161.2 |
| 5,423,089 | 6/1995 | Chun et al. | 2/161.3 |
| 5,517,694 | 5/1996 | Fabry | 2/161.4 |
| 5,557,806 | 9/1996 | Caswell et al. | 2/162 |
| 5,592,694 | 1/1997 | Yewer, Jr. | 2/161.1 |

FOREIGN PATENT DOCUMENTS

| | | | |
|---|---|---|---|
| 094000030 | 1/1994 | WIPO | 2/159 |

*Primary Examiner*—Jeanette E. Chapman

*Attorney, Agent, or Firm*—Whitham, Curtis, Whitham & McGinn

[57] ABSTRACT

A thumbguard 50 has a unique dynamization strap 30 which assists is resisting abduction of the basal joint. The strap 30 is contoured to fit neatly about a wearer's hand and be connected at both ends to adjacent portions of glove 12. Enlarged regions 34 and 36 assist in applying sufficient pressure across the surface of the hand to achieve abduction. Thumb abduction maximizes basal joint contact area and minimizes shear forces by maintaining the direction of force perpendicular to the joint surface. The dynamic nature of the strap 30 increases support pressure as the force of opposition increases, but still allows a comfortable degree of thumb and basal joint motion.

7 Claims, 10 Drawing Sheets

THUMBGUARD

BACKGROUND OF THE INVENTION

1. Field of the Invention

The present invention generally relates to a thumbguard and, more particularly, to a hand based, flexible splint designed to comfortably support the thumb in abduction.

2. Background Description

Acute injury or attenuation with repetitive stress can damage the trapezialmetacarpal ligament (beak ligament). Incompetence of this ligament may result in painful subluxation, synovitis and eventual degenerative arthritis of the trapezialmetacarpal joint (basal joint). Splinting the thumb in abduction minimizes stress on the trapezialmetacarpal ligament, and shear forces across the articular surfaces, and maintains the basal joint reduced. Abduction splinting can also counteract contracture of the adductor pollicis which contributes to further deformity and dysfunction after advanced arthritis is present.

According to Zancolli et al., *Clinical Orthopaedics and Related Research*, Number 200, Jul. 1987, pgs. 14–26, the trapezialometacarpal joint is structured to allow simple angular and simultaneous angular or rotational movements of the first metacarpal. Rotation of the first metacarpal during opposition (pronation) and retroposition (supination) depends on three factors: muscular activity, ligament tension and congruence of the spherical portion of the trapeziometacarpal joint.

FIG. 1 shows a strong pinch grip by the thumb and index finger. In opposition, the trapeziometacarpal joint is stable and depends on the automatic screwing mechanism of the first metacarpal secondary to the couple formed by the opposition muscles and the dorsal ligaments and good articular contact at the spherical part of the joint. A strong resultant force "R" runs through the trapeziometacarpal joint.

By contrast, with reference to FIG. 2, in retroposition, the trapeziometacarpal joint is unstable because of reduced articular contact and the physiologic palmar subluxation of the metacarpal. The resultant force "R" generated by pinching against the radial side of the hand tends to sublux the metacarpal base.

There have been various protective splints and supports which have been made to strengthen and support the thumb. For example, U.S. Pat. No. 4,658,441 to Smith discloses a thumb support comprising a support piece around the metacarpophalangeal joint of the thumb and a tab portion wrappable over the thumb/index web space. U.S. Pat. No. 4,953,568 to Theisler discloses a flexible, adjustable thumb brace wherein the brace encompasses the patient's hand with a separate thumb engageable portion. U.S. Pat. No. 5,356,371 to Hubbard discloses a thumb support that can be shaped to an individual's thumb using molds and strap connectors. U.S. Design Pat. No. 287,640 to Primiano shows a removable thumb sheath with a wrist collar. None of these support devices provides a simple one piece, one connector thumb support which effectively supports the thumb in abduction, and which can be positioned on a user's hand with minimal effort. In addition, none of the support devices provide a means for progressively increasing corrective force as the basal joint is stressed.

SUMMARY OF THE INVENTION

It is therefore an object of the present invention to provide a unique, flexible, hand based thumb abduction splint which is designed to be both more supportive and flexible than presently available carpometacarpal splints.

It is yet another object of this invention to provide a unique contoured dynamization strap which resists adduction of the basal joint, and which produces progressively increasing corrective force as the basal joint is stressed.

Thumb abduction maximizes the basal joint contact area and minimizes shear forces by maintaining the direction of force perpendicular to the joint surface. By encouraging basal joint abduction and thumb metacarpal phalangeal (MP) joint flexion, the splint and dynamization strap of this invention opposes the natural forces of basal joint collapse, basal joint adduction/subluxation and MP joint hyperextension. The dynamic nature of the strap increases supportive pressure as the force of opposition increases, but still allows a comfortable degree of thumb and basal joint motion.

According to the invention, the thumb support fits around a user's hand in a wrap-around manner and comprises two main members. The first member is a glove or mitten-like garment designed to fit over the user's hand. The top portion of the glove is preferably removed below the knuckles such that the fingers and hand can bend and move freely, and a passage is provided for the thumb to project from the glove. The glove is preferably made of a synthetic material, preferably neoprene, that includes thumb and finger passages and a strap for stabilizing the thumb muscles and ligaments. The second member is a contoured support strap attached to the base of the glove on the side of the user's thumb. The strap is shaped like a bow tie and fits around the user's hand over the glove. A fastening device is positioned on either the back side of the glove near the base of the thumb or on a portion of the contoured support strap which will be positioned near the base of the thumb after the strap is wrapped around the wearer's hand. The fastener is used to connect with another fastener positioned on the end of the strap, and the fasteners are connected after the strap has been wrapped around the user's hand in a specific manner. The contour in the strap allows the strap to be wrapped easily and neatly about the hand, and provides a mechanism which supplies sufficient pressure to achieve thumb abduction. In addition, the strap provides progressively increasing corrective force as the basal joint is stressed.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
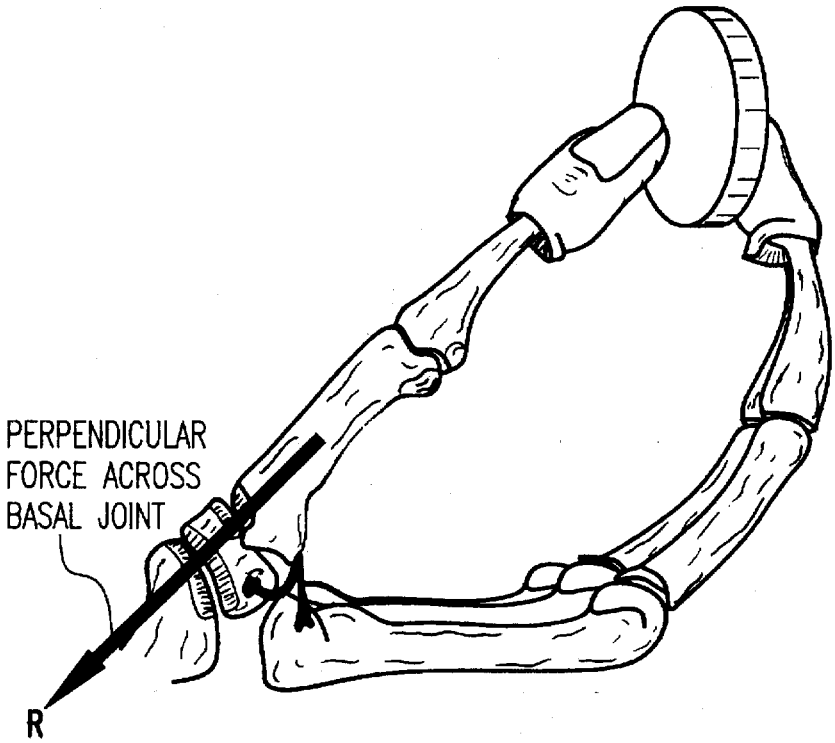
FIG. 1 PRIOR ART
FIG. 1 is a view of a thumb and index finger in opposition having a strong pinch grip, and a perpendicular force across the basal joint.
Figure 2:
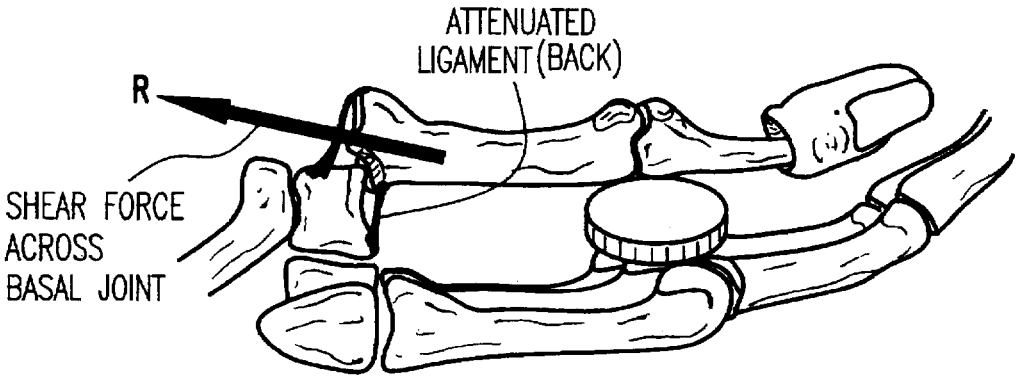
FIG. 2 PRIOR ART
FIG. 2 is a view of a thumb and index finger in retroposition with attenuation of the trapeziometacarpal ligament creating shear force across the basal joint.
Figure 3:
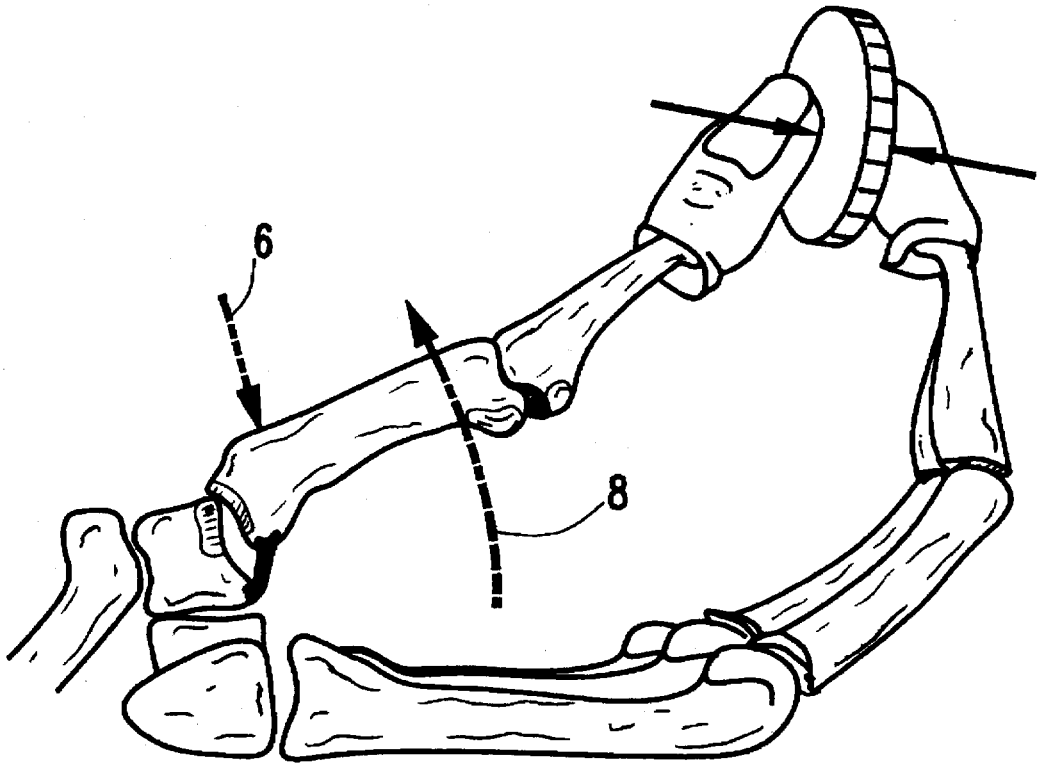
FIG. 3 is a view of a thumb and index finger illustrating the shear forces across the basal joint with ligament attenuation and joint subluxation. This figure also illustrates how thumb metacropalphalangeal joint hyperextension contributes to basal joint instability. Broken arrows show the corrective forces which are exerted by the thumbguard of the present invention.

Referring now to the drawings, and more particularly to FIG. 3, the thumbguard of the present invention is designed to exert corrective forces 6 and 8 at the basal and metacarpalphalangeal joints. The corrective forces 6 and 8 increase as the basal joint is stressed.

Figure 4:
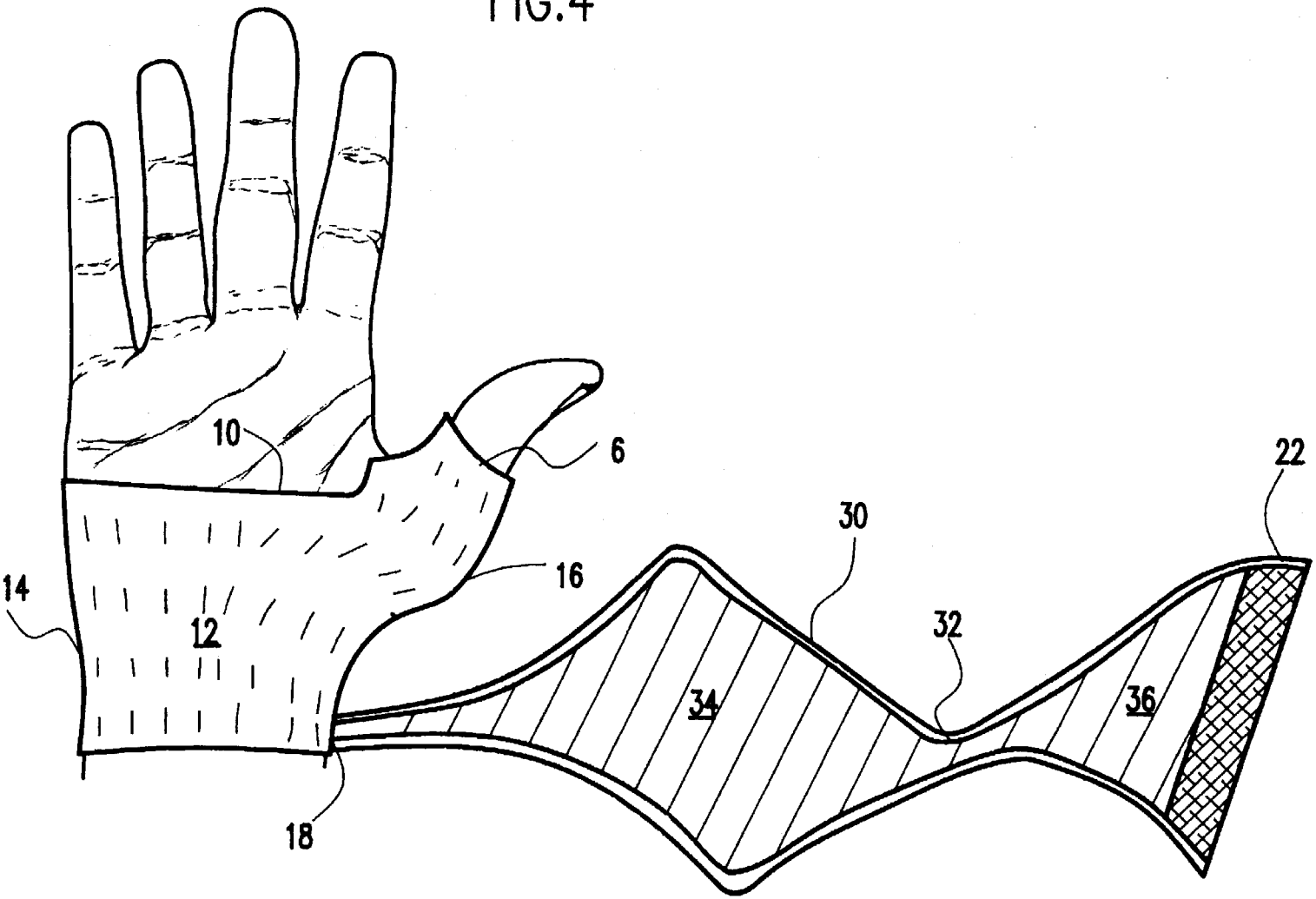
FIG. 4 is a top view of the palm side of the thumbguard of the present invention in an unwrapped configuration.

FIG. 4 shows a thumb support or thumbguard 50 for a user's right hand according to the present invention, where the thumb support 50 is in an unwrapped configuration. The thumb support 50 preferably includes a glove 12 which has a thumb passage 6 and a passage 10 for the fingers, and a contoured dynamization strap 30. The glove 12 can be made, for example, from neoprene, or any other suitable material that provides flexibility and elasticity to the thumb support 50; however, it should be understood that the material used for the support 50 can vary widely within the practice of this invention. It should also be understood that the hatchings in all of the figures do not designate any particular color or material, but rather, they are used for the purpose of clarity and differentiation (thus, in some instances, it may be desirable to make the dynamization strap 30 from the same material as the glove 12).

Figure 5A:
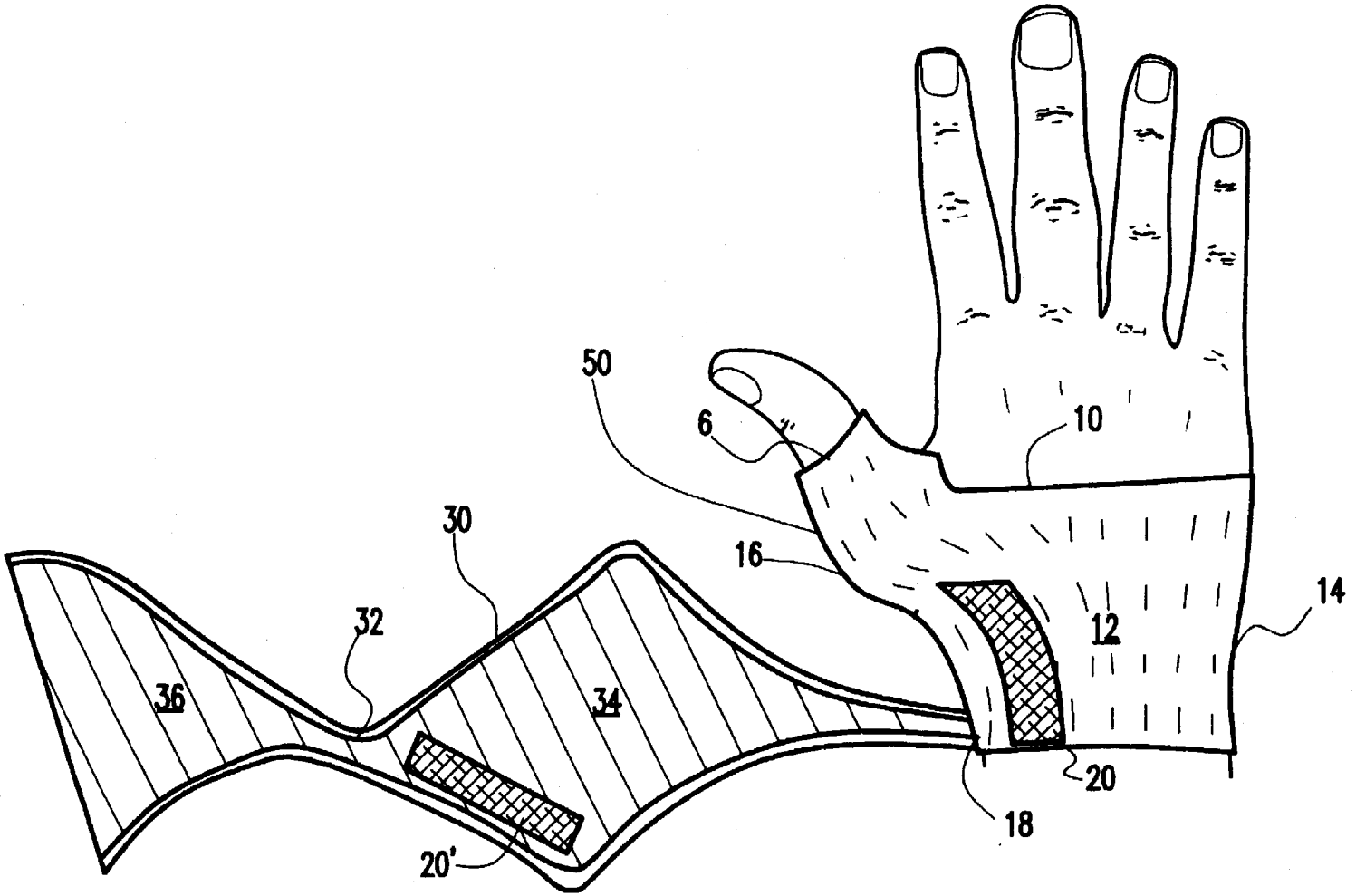
FIGS. 5A–D show the thumbguard of the present invention being wrapped around a user's hand.

As shown in FIGS. 4 and 5A a contoured dynamization strap 30 having a bow-tie shape is used for the purpose of applying supportive pressure to the thumb. The strap 30 includes two wide regions 34 and 36, one narrow region 32 and a narrow section 18. Preferably, narrow section 18 is permanently connected to glove 12 by sewing or the like such that the thumb support 50 is a one piece construction which can be easily stored, shipped and used by patients. The narrow section 18 is positioned adjacent the thumb side of the glove 12. A fastening means 20 can be positioned vertically at the base of the thumb support 50 beneath the thumb-index finger web and extended along the thumb, or, alternatively, a fastening means 20' can be positioned in wide region 34 adjacent a contoured edge such that it will be positioned vertically near the base of the thumb support 50 beneath the thumb-index finger web (see FIG. 5*c*). The material for the fastening means 20 or 20' is preferably hook and loop tape (velcro®) since it is flexible enough to allow comfortable movement of the hand and wrist. However, it should be understood that a variety of different fastening devices may be used in the invention such as snaps, hooks or zippers. A second fastening means 22 is located at the end of the dynamization strap 30 shown in FIGS. 4, 5B and 5D. The second fastening means interacts with fastening means 20 or 20' after the dynamization strap has been wrapped around the user's hand. Preferably, the second fastening means will be a second half of hook and loop tape, a zipper of a snap.

The strap 30 is specially contoured and has a "bow tie" shape so that it may wrap around a user's hand and fit precisely over the glove 12. In some applications a flexible and stretchable material (e.g., lycra or spandex) is used so that the strap 30 may shrink and stretch as necessary to fit the user's hand. However, it is preferable that the strap 30 be made of stiffer material than the glove 12, to provide the progressively increasing supportive force. Suitable materials include canvas, pack cloth, leather, and cordura. As is discussed below, the strap 30 is wound comfortably around the hand so as not to restrict the user's motion, inflict pain or cause annoyance.

Figure 5B:
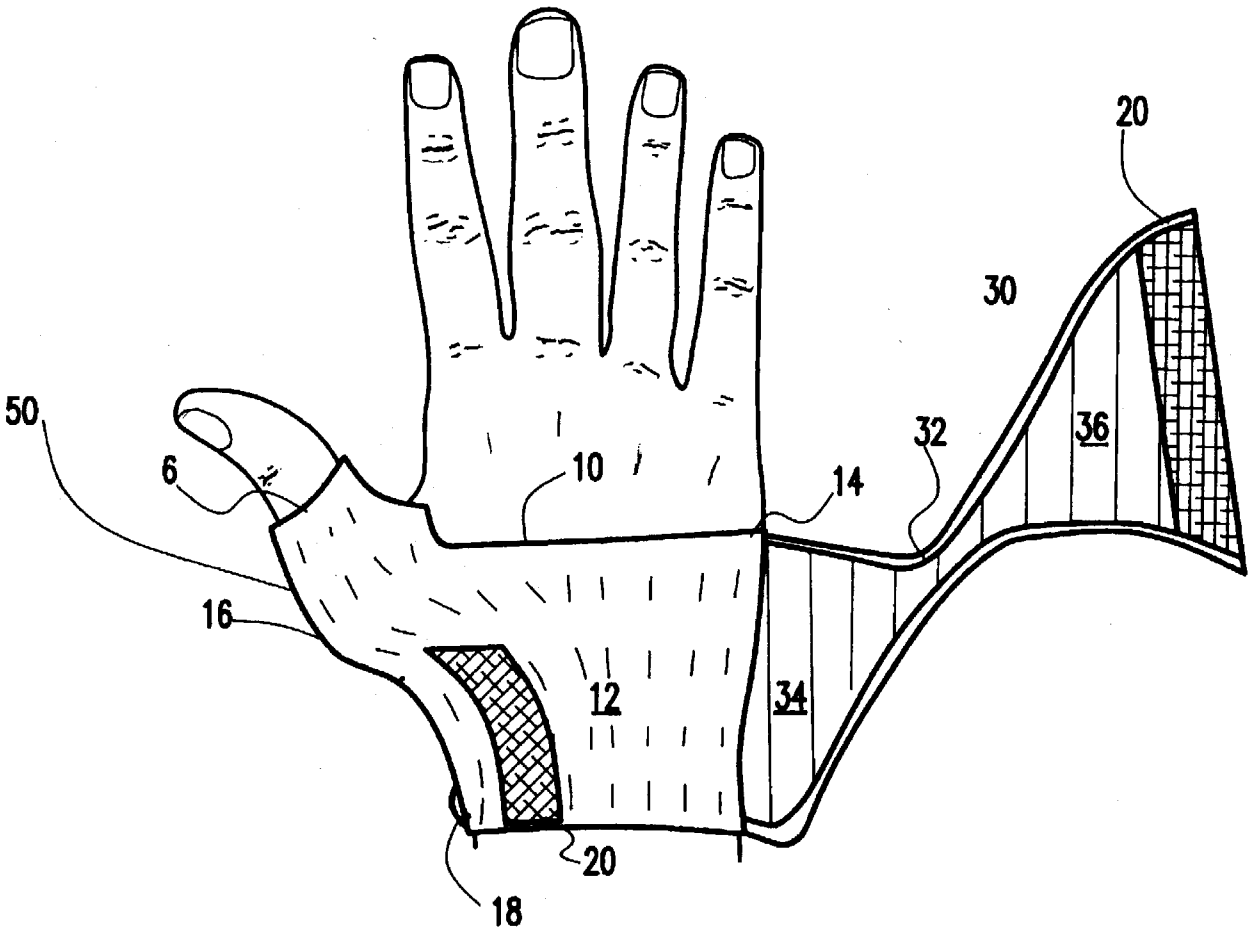
Figure 5C:
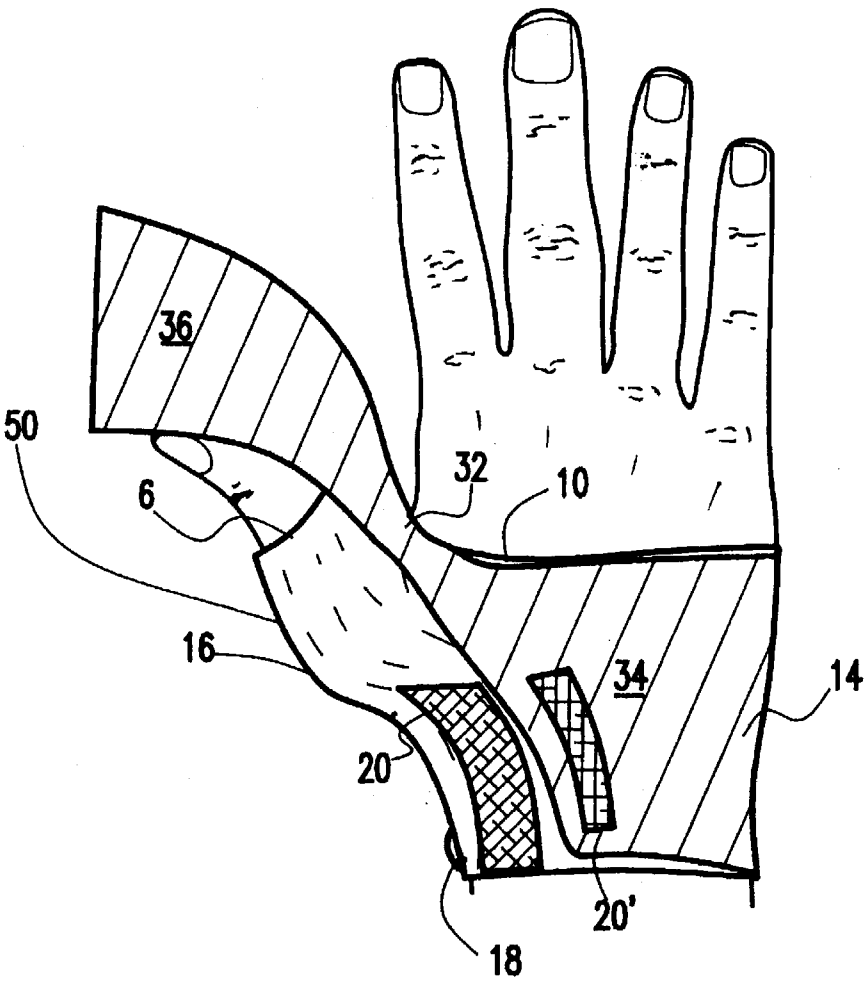
Figure 5D:
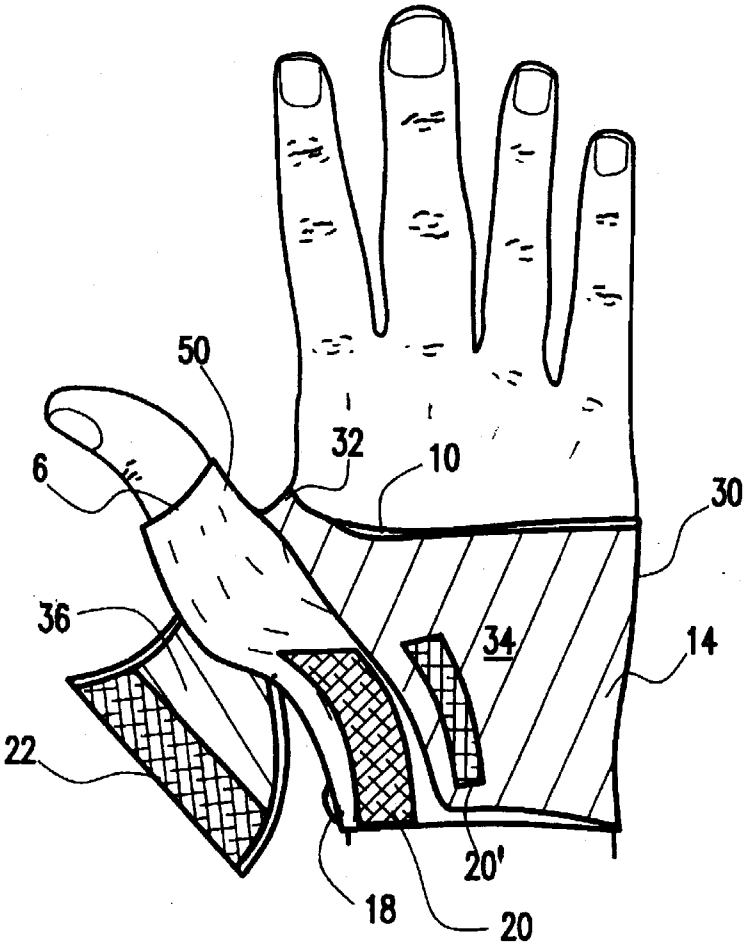

As shown in FIG. 5B, wide region 34 wraps around the ulnar side of the palm 14. This wrapping of the strap applies pressure toward the middle of the palm. At this step, both fastening means 20 and 22 are visible. However, if a fastening means 20' were employed, it would not be visible at this step. In FIG. 5C, the wide region 34 has been wrapped completely over the back of the hand, and region 34 has covered the ulnar side of the hand 14. In FIG. 5D, the narrow region 32 has been fit through the thumb-index finger web. The narrowness of the strap 30 is important since the region 32 must fit comfortably between the thumb and index finger. Preferably, region 32 is less than 1" in width. The strap 30 is then wound around the back of the thumb. Again, both fastening means 20 (or 20') and 22 are visible in this drawing.

Figure 6A:
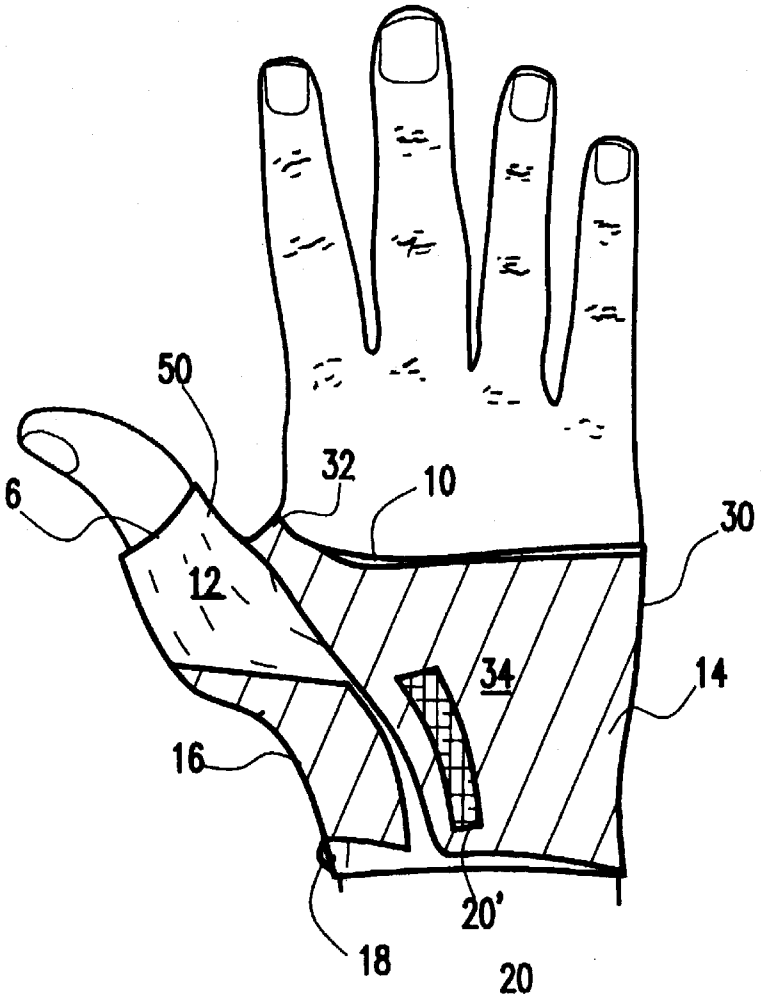
FIGS. 6A–B show back side views of alternative thumbguard fastening positions.

FIG. 6*a* shows the thumbguard in the complete wrapped configuration where fastening means 20 is utilized. Wide region 36 has been pulled over the thumb side 16 of the palm. Fastening means 20 and 22 have been connected to ensure stability of the dynamization strap. The strap 30 pulls the thumb muscles and ligaments into their correct positions (thumb abduction) thereby correcting the problems of thumb retroposition.

Figure 6B:
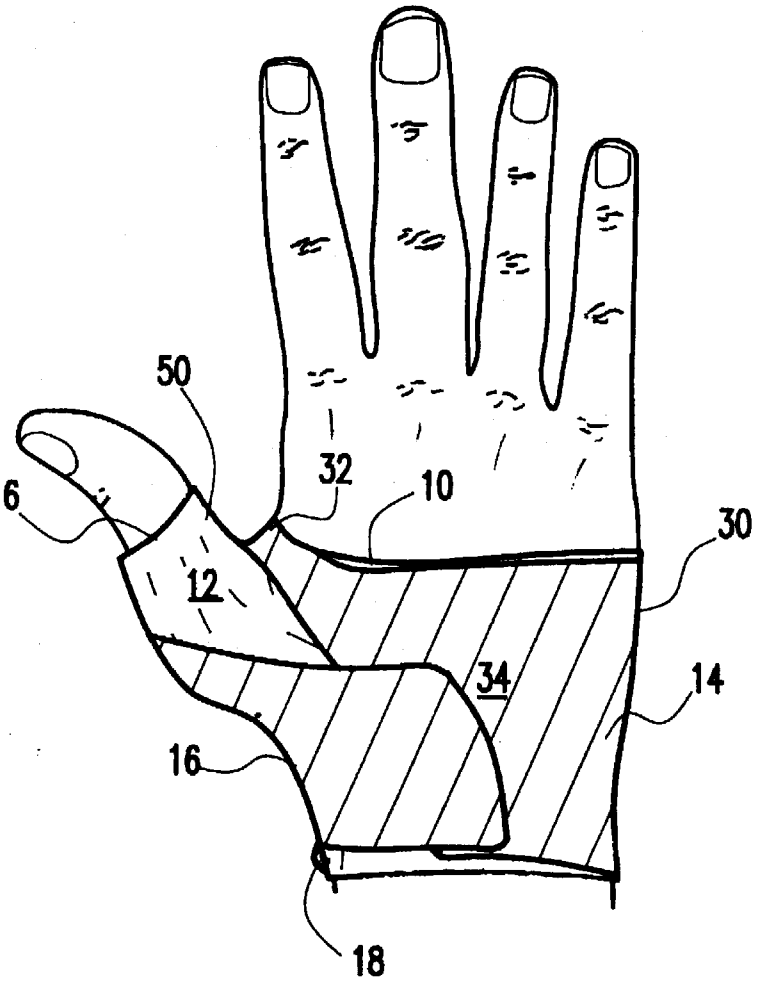

FIG. 6B shows an alternative thumbguard design wherein fastening means 20' is used. The strap 30 will pull the thumb muscles and ligaments into their correct positions (thumb abduction) thereby correcting the problems of retroposition in the same manner as is shown in FIG. 6A. The chief difference between FIGS. 6A and 6B is that the fasteners 20' and 22 are both positioned on the dynamization strap 30. The design of FIG. 6B may have manufacturing advantages since the fasteners are secured to the same element (strap 3), rather than alternative elements (glove 12 and strap 30).

Alternatively, a thumbguard might include both fastening means 20 and fastening means 20', so that the wearer will be able to adjust the connection point to suit his or her comfort requirements.

Figure 7:
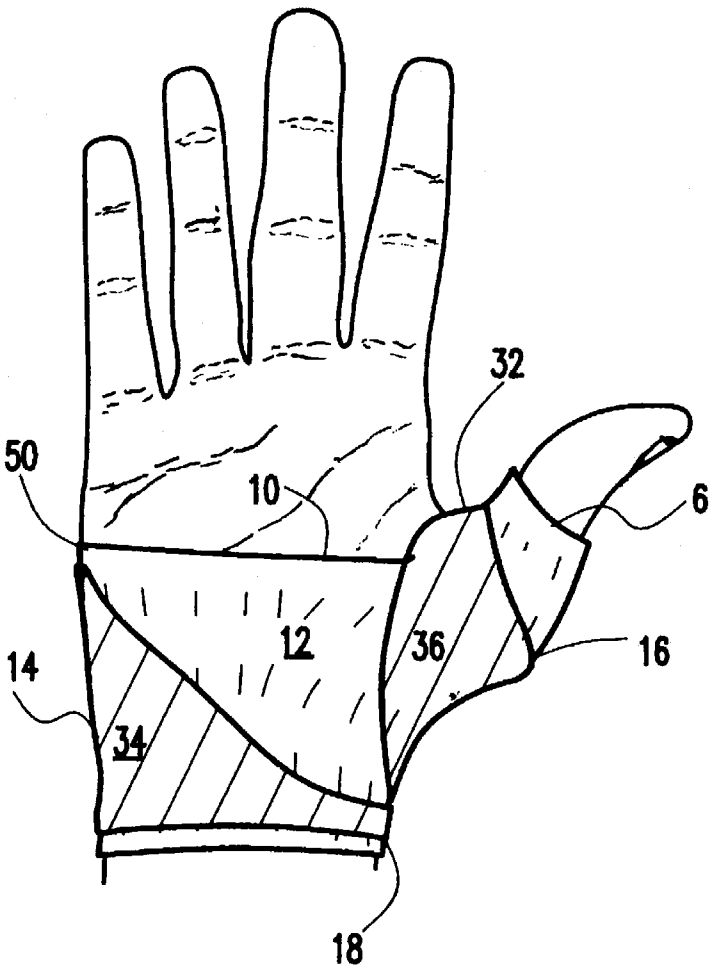
FIG. 7 is a top view of the palm side of the thumbguard in the wrapped configuration.

FIG. 7 shows the palm side view of the thumbguard in the wrapped configuration. The regions of the strap, 34, 32 and 36 are shown wrapped around the hand.

For exemplary purposes only, the dimensions of the strap are as follows:

Length: 8"–12"

Width at region 34: 3"–5"

Width at region 36: 2"–4"

Width at region 32: <1" preferably 0.3"–0.6"

Width at region 18: <1" preferably same as 32 (0.3"–0.6")

An important aspect of this invention is that the user is able to comfortably move his thumb and hand, naturally, without discomfort, pain or annoyance. In this regard, the materials for the glove 12, the fastening means 20, and the dynamization strap 30 should be carefully considered so as to minimize limitation of movement and flexibility.

In addition to its unique design configuration, the thumb support 50 of the present invention is anticipated to have many applications. The support may be used to treat disorders of the basal joint of the thumb including synovitis, painful subluxation and arthritis. A forearm based splint employing the described dynamization strap could also be used to treat DeQuervains Tenosynovitis and other wrist/thumb disorders. It may also have a prophylactic industrial role where repetitive pinching and thumb triggering may contribute to certain cumulative trauma disorders.

While the invention has been described in terms of its preferred embodiments, those skilled in the art will recognize that the invention can be practiced with modification within the spirit and scope of the appended claims.

I claim:

1. A thumb support, comprising:

a glove which fits around a user's hand;

a contoured strap having a first end and a second end, said first end being connected to said glove, said contoured strap being sized to wrap around a hand of a user, said contoured strap having first and second wide regions separated by a narrow region wherein said second wide region is positioned at said second said contoured strap; and first and second fasteners which are selectively joinable to each other, said first fastener being positioned at a location selected from the group consisting of said first wide region of said contoured strap and a surface of said glove, and said second fastener being positioned on said contoured strap at said second end.

2. A thumb support as recited in claim 1 wherein said first fastener is positioned at a location on said first wide region of said contoured strap.

3. A thumb support as recited in claim 1 wherein said first fastener is positioned on said surface said glove adjacent a thumb region of said glove.

4. A thumb support as recited in claim 1 wherein said first and second fasteners are hook and loop tape.

5. A thumb support as recited in claim 1 wherein said contoured strap is connected to said glove adjacent a thumb region of said glove.

6. A thumb support as recited in claim 1 further comprising a third fastener selectively joinable to said second fastener, said third fastener being positioned at a location selected from the group consisting of said first wide region of said contoured strap and a surface of said glove.

7. A method for securing a thumb support to a user's hand, comprising the steps of:

inserting a user's hand into a glove which fits around said user's hand, said glove having a contoured strap connected thereto which comprises first and second wide regions separated by a narrow region;

positioning said first and second wide regions of said contoured strap on opposite sides of said user's hand;

positioning said narrow region of said contoured strap in a web space between a thumb and an index finger of said user's hand; and securing a first fastener to a second fastener, said first fastener being positioned at a location selected from the group consisting of said first wide region of said contoured strap and a surface of said glove, said second fastener being positioned on said second wide region of said contoured strap.

* * * * *